US008100053B2

(12) United States Patent
Grunder et al.

(10) Patent No.: US 8,100,053 B2
(45) Date of Patent: Jan. 24, 2012

(54) METHOD FOR MANUFACTURING BOUND PRINTED PRODUCTS SUCH AS BOOKS, JOURNALS, MAGAZINES AND THE LIKE, PERFORMED AT LEAST PARTIALLY DEPENDENT ON A WORKING CYCLE

(75) Inventors: Roland Grunder, Vordemwald (CH); Günther Silberbauer, Oftringen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/510,457

(22) Filed: Aug. 25, 2006

(65) Prior Publication Data

US 2006/0292939 A1 Dec. 28, 2006

(51) Int. Cl.

| | |
|---|---|
| ***B41F 13/56*** | (2006.01) |
| ***B41F 13/54*** | (2006.01) |
| ***B41F 13/24*** | (2006.01) |
| ***B42C 9/00*** | (2006.01) |

(52) U.S. Cl. ..... 101/226; 101/225; 101/227; 101/228; 101/232; 412/1; 412/8; 412/9

(58) Field of Classification Search ..... 101/226–227, 101/225, 228, 232, 480; 412/1, 3, 6, 8, 9, 412/17, 33, 35, 36; 270/52.26, 52.29, 52.3; 226/110; 493/405

See application file for complete search history.

(56) References Cited

U.S. PATENT DOCUMENTS

| | | | | |
|---|---|---|---|---|
| 3,697,061 | A | 10/1972 | Levine et al. | |
| 3,897,051 | A * | 7/1975 | Muller | 270/43 |
| 4,408,755 | A * | 10/1983 | Meier | 270/52.09 |
| 4,524,962 | A * | 6/1985 | Davenport et al. | 270/21.1 |
| 5,147,276 | A * | 9/1992 | Stab | 493/444 |
| 5,295,775 | A | 3/1994 | Andjelic et al. | |
| 5,887,863 | A * | 3/1999 | Hollenstein et al. | 270/52.18 |
| 6,095,740 | A | 8/2000 | Hollenstein et al. | |
| 6,139,003 | A * | 10/2000 | Michalik et al. | 270/52.17 |
| 6,234,947 | B1 * | 5/2001 | Michalik | 493/425 |
| 6,363,851 | B1 | 4/2002 | Gerhard et al. | |
| 6,708,967 | B1 * | 3/2004 | Trovinger et al. | 270/52.26 |
| 6,827,012 | B1 * | 12/2004 | Palmatier | 101/225 |

FOREIGN PATENT DOCUMENTS

EP 0962334 12/1999

* cited by examiner

*Primary Examiner* — Ren Yan
*Assistant Examiner* — Marissa Ferguson Samreth
(74) *Attorney, Agent, or Firm* — Lucas & Mercanti, LLP; Klaus P. Stoffel

(57) ABSTRACT

In a method for at least partially cycle-dependent manufacturing of bound printed products by adhesive binding printed sheets in a spine area of an book block or by stitching with staples folded edges of printed sheets collected astraddle, a sequentially double-sided digitally printed paper web or individual sheets are transversely cut to from the printed sheets. The printed sheets are then transversely folded and subsequently supplied either to an adhesive binding station or to a saddle-shaped conveying support for stitching with staples.

17 Claims, 1 Drawing Sheet

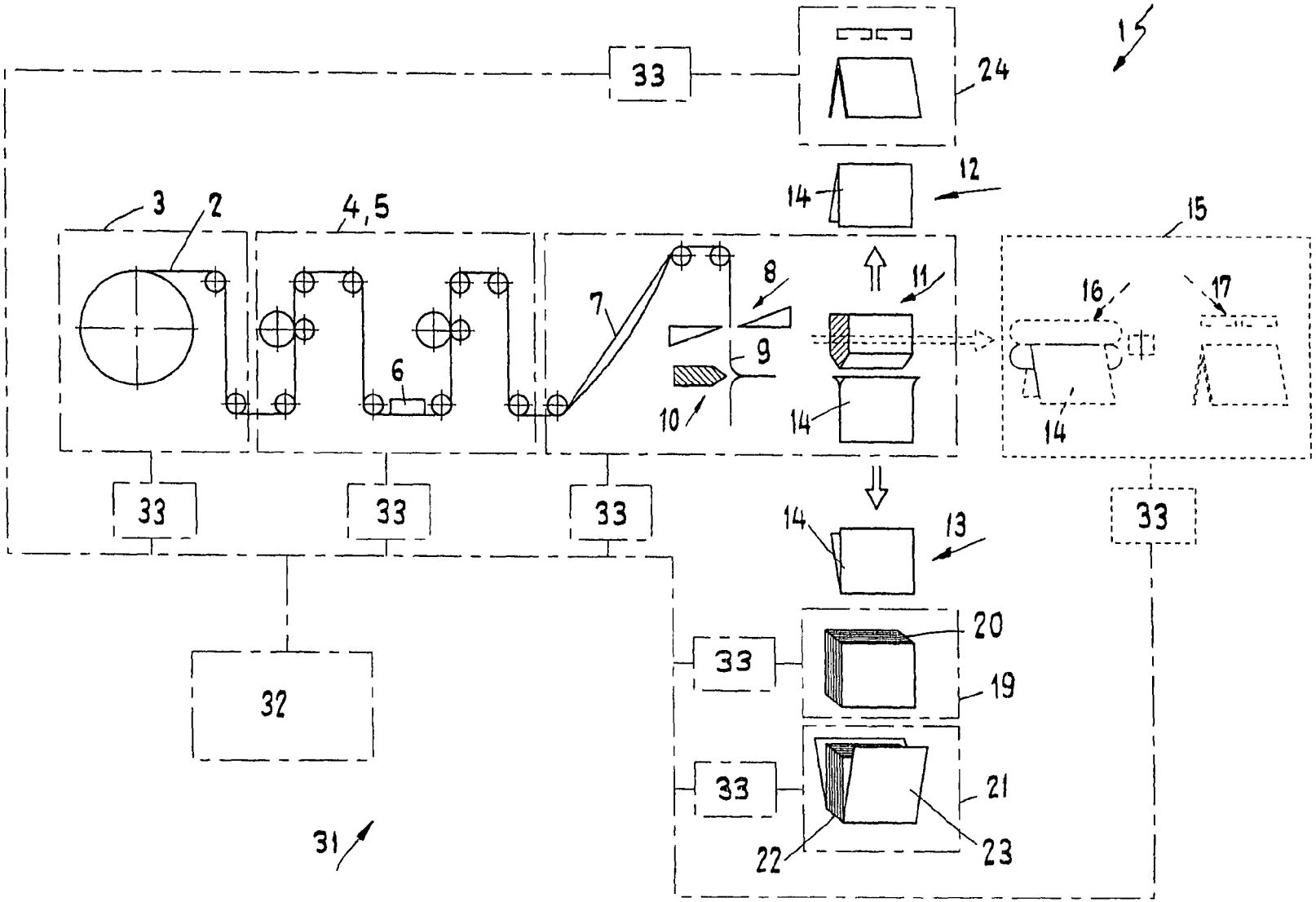
1
2
3
4, 5
6
7
8
9
10
11
12
13
14
15
16
17
19
20
21
22
23
24
31
32
33

METHOD FOR MANUFACTURING BOUND PRINTED PRODUCTS SUCH AS BOOKS, JOURNALS, MAGAZINES AND THE LIKE, PERFORMED AT LEAST PARTIALLY DEPENDENT ON A WORKING CYCLE

BACKGROUND OF THE INVENTION

1. Field of the Invention

The invention relates to a method for manufacturing bound printed products such as books, journals, magazines or the like, by adhesive binding of printed sheets in the spine area of a formed book block (book in sheets) or by stitching the folded edges of printed sheets collected astraddle by means of staples, the printed sheets made from a printed web printed on both sides sequentially by digital printing or from individual sheets, wherein at least partially the manufacture is carried out as a function of the working cycle. This means that the manufacture according to the aforementioned kind is carried out in the sequence of the pages of the printed products.

2. Description of the Related Art

A method of this kind is known from the brochure "Your Partner in Print Finishing" published by the Company C.P. Bourg S. A. NV, Ottignies, Belgium.

In a brochure "Print-on-demand Books with IBM in Full Print Solutions", IBM UK Ltd. and Ireland Ltd. offer machines for performing the aforementioned method.

SUMMARY OF THE INVENTION

It is an object of the present invention to provide a method of the aforementioned kind with which, after printing a paper web or individual sheets, it is possible to produce printed products that are adhesive-bound or stitched on a saddle.

In accordance with the present invention, this is achieved in that the printed paper web is cut transversely to form printed sheets and is folded transversely and in that the printed sheets are subsequently optionally supplied to an adhesive binding process or to a saddle-shaped conveying support for stitching by staples.

The user of this method is enabled to provide a higher production output which can be performed under favorable conditions.

It is advantageous when for small-sized printed products the printed paper web before transverse cutting is folded longitudinally so that the printed product has twice the number of sheets.

Preferably, for optimizing the number of pages of a printed product, the transversely folded printed sheet can be provided with a longitudinal fold before carrying out adhesive binding or staple stitching processes.

In particular in the case of printed products of a small size it is favorable when the longitudinal fold is produced as a former fold (newspaper fold) or a plough fold.

Expediently, the transverse fold is produced by means of a knife because a knife folding machine enables a higher production output while providing the required quality.

The longitudinal fold, which is produced after forming the transverse fold, is advantageously produced by means of a knife which is beneficial for the alignment of the printed sheets for the subsequent gather stitching or adhesive binding.

Alternatively, this longitudinal fold can be produced on the conveying path for the gather stitching operation by means of a continuous folding device so that a subsequent opening of the printed sheets is no longer needed.

In order to eliminate subsequent folding, the printed sheets can be collected astraddle to intermediate products for subsequent staple stitching.

In order to enable a change of the size of the printed product and/or of the position of a fold without defective products, the changing operation is carried out with a temporal spacing between two printed sheets that differ from one another.

Advantageously, the change is carried out while the device is running so that no production interruption results.

For performing the method, a device can be provided which has an uncoiling station for uncoiling a paper web from a reel/and a printing device which digitally prints onto at least one side of the supplied paper web images or text, wherein downstream thereof a transverse cutter for separating the printed paper web into separate printed sheets for the subsequent further processing by adhesive binding or gather stitching is provided. Instead of the paper web, it is also possible to employ individual sheets as the starting product, wherein a feeding station for individual sheets is provided.

Advantageously, downstream of the transverse cutter a folding device is provided which produces a fold transversely to the conveying direction of the paper web or of the individual sheets. The folded sheets are then guided from the folding device to a conveying path extending at a right angle to the conveying direction to an adhesive binding device or a gather stitcher.

For optimizing the number of pages of the printed product, the conveying path may have correlated therewith a folding device for producing a longitudinal fold oriented in the conveying direction of the printed sheet, wherein this folding device can be arranged upstream of the conveying paths or along a conveying path.

Preferably, the conveying path correlated with the adhesive binding process has a collecting device for collecting the printed sheets to a book block (book in sheets); this collecting device ensures a continuous processing.

The conveying path for the gather stitcher is comprised of a saddle-shaped conveying device, on which the printed sheets are collected astraddle to intermediate products, and of a stitching device correlated therewith.

The uncoiling station, printing devices, transverse cutters, folding devices, adhesive binding system and gather stitcher system, all of which form the processing stations of the device, are connected with one and another at least over sections of the processing path dependent on the working cycle or the machine cycle.

For this purpose, the device has a control device which is connected with the drive devices of the processing stations. Each drive device of a processing station is configured as a machine control which is connected to a processing line control of the control device.

The processing line control is configured to be programmable by means of a computer and transmits signal to the machine controls of the individual processing stations.

The machine control of each processing station has at least one controllable electric motor which, together with a control unit, forms a drive unit wherein the control unit is connected to the processing line control.

In the following, the invention will be explained in connection with one embodiment illustrated in the drawings to which reference is being had in connection with all details not explained explicitly in the specification.

BRIEF DESCRIPTION OF THE DRAWING

In the drawing the only FIGURE shows a device for performing the method according to the invention for manufacturing printed products, such as books, journals, magazine and the like.

DESCRIPTION OF THE PREFERRED EMBODIMENTS

The illustrated embodiment shows a device 1 for performing a method for manufacturing printed products such as books, journals, magazines or the like, wherein the manufacture is at least partially working cycle-dependent. In the sequence of the processing steps, the device 1 is comprised of an uncoiling station 3 for a paper web 2 to be removed from a reel. The paper web 2 is guided from the reel to sequentially arranged digital printing devices 4, 5 so that the paper web 2 can be printed on both sides, in particular, since a deflection rod 6 is arranged between the printers 4, 5. Downstream thereof, a longitudinal folding device 7 is arranged which is configured to fold the paper web 2 so as to have a former fold (newspaper fold) or plough fold parallel to the conveying direction. Subsequently, the printed paper web 2 passes through a transverse cutter 8 where it is cut into individual sheets 9 and then supplied to a transverse folding apparatus 10.

The folded printed sheets then move through a longitudinal folding device 11, which performs folding parallel to the supply or feed direction, and are then guided to one of the two conveying paths 12, 13 arranged at a right angle to the conveying direction F. One conveying path 12 is correlated with a gather stitcher, and the other conveying path 13 is correlated with an adhesive binding device. Of course, the printed sheets 14, after undergoing transverse folding at the folding apparatus 10, can be supplied on a straight path through a continuous folding device to a gather stitcher 15. A collecting device 16 and a stitching device 17 of such a gather stitcher 15 are illustrated in the FIGURE.

On the conveying paths 13 extending to the adhesive binding station the printed sheets 14 are collected by a collecting device 19 to book blocks (books in sheets) 20 and are subsequently supplied to the adhesive binder 21 for the adhesive binding process. As is known in the art, the spine 22 of the book blocks (books in sheets) are mechanically processed, an adhesive is applied, and a cover 23 is also attached. On the opposite side, the printed sheets 14 are collected for stitching on a conveying support (not shown) and are then supplied to a stitcher 24. In the illustrated embodiment the printed sheets 14 are supplied with the fold leading to the gather stitching process or adhesive binding process.

In order to effect actuation, the device 1 has a drive arrangement which is connected to a control device 31. The control device 31 is comprised of a processing line control 32, which can be programmed by a computer, and machine controls 33 correlated with the processing stations.

The machine control 33 of the individual processing stations or processing devices, such as, for example, the uncoiling device, printer devices, and so on, has an electric motor or a servo motor which together with a control unit forms a drive unit so that the cycle-dependent processing devices can be operated phase-shifted relative to one another.

While specific embodiments of the invention have been shown and described in detail to illustrate the inventive principles, it will be understood that the invention may be embodied otherwise without departing from such principles.

What is claimed is:

1. A method for at least partially cycle-dependent manufacturing of bound printed products by adhesive binding printed sheets in a spine area of a book block or by stitching with staples folded edges of printed sheets collected astraddle, the printed sheets made from a sequentially double-sided digitally printed paper web or from individual sheets, the method comprising the steps of:

uncoiling the paper web or supplying individual sheets;

printing images or text on at least one side of the paper web or individual sheets;

transversely cutting the printed paper web or individual sheets into printed sheets in a transverse cutting station;

folding the printed sheets transversely to a conveying direction of the printed sheets in a transverse folding station downstream of the transverse cutting;

providing an adhesive binding station;

providing a gather stitcher station;

subsequently optionally supplying the printed sheets to a first conveying path downstream of the transverse folding station and extending at a right angle to the conveying direction of the printed sheets and leading to the adhesive binding station or to a second conveying path arranged downstream of the transverse folding station and extending at a right angle to the conveying direction of the printed sheets and leading to the gather stitcher so that the printed sheets undergo adhesive binding or stitching.

2. The method according to claim 1, further including the step of longitudinally folding the printed paper web or individual sheets before the step of transversely cutting.

3. The method according to claim 2, wherein the longitudinal fold is a former fold or a plough fold.

4. The method according to claim 1, further comprising the step of longitudinally folding the printed sheets after the step of transversely folding and before carrying out adhesive binding or stitching.

5. The method according to claim 4, wherein the step of longitudinally folding is carried out by a knife.

6. The method according to claim 1, wherein the step of transverse folding is carried out by a knife.

7. The method according to claim 1, further comprising the step of collecting the printed sheets to stacks forming a book block before adhesive binding.

8. The method according to claim 1, further comprising the step of collecting the printed sheets astraddle on the saddle-shaped conveying support to form intermediate products.

9. The method according to claim 1, wherein the printed sheets are formed of the entire width of the paper web.

10. A device for at least partially cycle-dependent manufacturing of bound printed products by adhesive binding printed sheets in a spine area of an book block or by stitching with staples folded edges of printed sheets collected astraddle, the printed sheets made from a sequentially double-sided digitally printed paper web or from individual sheets, wherein the printed paper web or individual sheets are transversely cut to printed sheets, the printed sheets are transversely folded, and subsequently supplied either to an adhesive binding station or to a saddle-shaped conveying support for stitching with staples; the device comprising:

an uncoiling station for a paper web rolled onto a reel or a feeding station for supplying individual sheets;

a digital printing station for printing the paper web or individual sheets at least on one side with images or text;

a transverse cutting station for separating the printed paper web or individual sheets into printed sheets for further processing by adhesive binding or gather stitching;

a transverse folding station arranged downstream of the transverse cutter for folding the printed sheets transversely to a conveying direction of the printed sheets;

an adhesive binding station;

a gather stitcher station;

a first conveying path arranged downstream of the transverse folding station and extending at a right angle to the conveying direction of the printed sheets and leading to the adhesive binding station;

a second conveying path arranged downstream of the transverse folding station and extending at a right angle to the conveying direction of the printed sheets and leading to the gather stitcher;

wherein the printed sheets are optionally supplied either to the first conveying path or the second conveying path to undergo adhesive binding or stitching.

11. The device according to claim 10, further comprising a longitudinal folding device configured to produce a longitudinal fold in the paper web or the individual sheets and arranged upstream of the transverse cutting station.

12. The device according to claim 10, further comprising a longitudinal folding device configured to form a longitudinal fold and arranged downstream of the transverse folding station and correlated with the first and second conveying paths.

13. The device according to claim 10, wherein the first conveying path has a collecting device for collecting printed sheets to book blocks.

14. The device according to claim 10, wherein the second conveying path correlated with the gather stitcher has a saddle-shaped conveying support for collecting astraddle the printed sheets to form intermediate products and a stitching device arranged downstream of the saddle-shaped conveying support.

15. The device according to claim 10, further comprising a control device.

16. The device according to claim 15, wherein the control device comprises a processing line control and several machine controls for controlling the stations of the device.

17. The device according to claim 15 or 16, wherein the machine controls comprise an electric motor and a control unit, respectively, wherein the electric motor and the control unit together form a drive unit.

* * * * *

UNITED STATES PATENT AND TRADEMARK OFFICE

CERTIFICATE OF CORRECTION

PATENT NO. : 8,100,053 B2
APPLICATION NO. : 11/510457
DATED : January 24, 2012
INVENTOR(S) : Roland Grunder et al.

It is certified that error appears in the above-identified patent and that said Letters Patent is hereby corrected as shown below:

On the Title Page, Item (62) should read

Related U.S. Application Data

(62) Continuation of application No. 10/227,230, filed on Aug. 23, 2002, now abandoned.

On the Title Page, Item (30) should read

(30) Foreign Application Priority Data

Sep. 3, 2001 (EP) ..... 01810848.0-2304

Signed and Sealed this
Twenty-seventh Day of August, 2013

Teresa Stanek Rea
*Acting Director of the United States Patent and Trademark Office*